US007032524B1

(12) United States Patent
Pajerski

(10) Patent No.: US 7,032,524 B1
(45) Date of Patent: Apr. 25, 2006

(54) ADJUSTABLE LATCHING MECHANISM

(75) Inventor: Francis L. Pajerski, Elkhorn, WI (US)

(73) Assignee: Palmer Snyder Furniture Co., Elkhorn, WI (US)

( * ) Notice: Subject to any disclaimer, the term of this patent is extended or adjusted under 35 U.S.C. 154(b) by 375 days.

(21) Appl. No.: 10/365,213

(22) Filed: Feb. 12, 2003

(51) Int. Cl.
*A47B 5/00* (2006.01)

(52) U.S. Cl. ..... 108/168; 297/158.4

(58) Field of Classification Search ..... 248/188.5; 297/158.4; 108/166, 167, 168, 169, 171, 108/172, 173, 174, 115, 147.19, 147.2, 144.11; 292/100, 126, 200, 226, 95, 109, 129, 229, 292/236, 210, 304, 44, 45, 49; 403/322.1, 403/322.4

See application file for complete search history.

(56) References Cited

U.S. PATENT DOCUMENTS

| | | | | |
|---|---|---|---|---|
| 1,360,052 | A | 11/1920 | Streich | |
| 2,372,471 | A * | 3/1945 | Campbell | 135/66 |
| 2,764,460 | A * | 9/1956 | Nelson | 108/169 |
| 3,101,064 | A * | 8/1963 | Kanzelberger | 108/168 |
| 3,112,954 | A * | 12/1963 | Kanitz | 297/158.4 |
| 3,191,991 | A * | 6/1965 | Anderson et al. | 297/158.4 |
| 3,688,789 | A * | 9/1972 | Bunch | 135/67 |
| 3,799,073 | A * | 3/1974 | Nielsen | 108/169 |
| 4,054,096 | A * | 10/1977 | Wilson et al. | 108/169 |
| 4,143,602 | A | 3/1979 | Brunn | |
| 4,191,111 | A | 3/1980 | Emmert | |
| 4,561,622 | A | 12/1985 | Heinzel | |
| 4,596,196 | A | 6/1986 | Gunter et al. | |
| 4,606,575 | A | 8/1986 | Kodet | |
| 5,014,628 | A | 5/1991 | Roberts | |
| 5,109,778 | A | 5/1992 | Berkowitz et al. | |
| 5,323,713 | A | 6/1994 | Luyk et al. | |
| 5,421,272 | A | 6/1995 | Wilmore | |
| 5,528,997 | A | 6/1996 | Miller | |
| 5,577,452 | A | 11/1996 | Yindra | |
| 5,606,922 | A | 3/1997 | Adams et al. | |
| 5,673,633 | A | 10/1997 | Pfister | |
| 5,683,201 | A * | 11/1997 | Guaron | 403/325 |
| 5,845,589 | A | 12/1998 | Pfister | |
| 5,913,272 | A | 6/1999 | Gutgsell et al. | |
| 6,192,808 | B1 | 2/2001 | Bue | |
| 6,223,661 | B1 | 5/2001 | Griepentrog | |
| 6,254,178 | B1 | 7/2001 | Bue | |
| 6,293,451 | B1 * | 9/2001 | LeMay et al. | 224/509 |
| 6,347,777 | B1 * | 2/2002 | Webber et al. | 248/354.1 |
| D479,773 | S * | 9/2003 | Pajerski et al. | D6/337 |
| 6,739,560 | B1 * | 5/2004 | Pajerski | 248/188.5 |
| 6,752,091 | B1 * | 6/2004 | Glover et al. | 108/168 |
| 2002/0020438 | A1 * | 2/2002 | Best | 135/69 |

* cited by examiner

*Primary Examiner*—Jose V. Chen
(74) *Attorney, Agent, or Firm*—Jansson, Shupe, Munger & Antaramian, Ltd.

(57) ABSTRACT

An adjustable latching mechanism for securing together first and second leg support members on an institutional folding table. The latching mechanism comprises a first latching member slidably mounted to the first leg support member and a second latching member mounted to the second leg support member. The first latching mechanism can be extended and retracted between limits so as to permit a multiplicity of positions where the second latching member can engage the first latching member. The first latching member may either be an adjustable latch or an adjustable catch. The latching mechanism is preferably used on a center leg support to maintain the table in a substantially unfolded position.

20 Claims, 4 Drawing Sheets

ADJUSTABLE LATCHING MECHANISM

FIELD OF THE INVENTION

This invention is related generally to latching mechanisms and, more particularly, to adjustable latching mechanisms for institutional folding tables.

BACKGROUND OF THE INVENTION

Institutional tables of the type that can be folded for storage and then unfolded for use are commonly found in schools and churches across the country. These tables will often have a table top comprised of two sections hinged together as well as being oftentimes joined to bench or stool seating. The supporting structure for many of these tables will include a center leg support and two outer leg supports.

The center leg support is comprised of an upper member and a lower member wherein the lower member is capable of telescopically collapsing within the upper member. The center leg support is mechanically connected to the table top sections and seating sections in such a manner that when the table is folded, the lower member is free to separate from the upper member by moving downward from the upper member, thereby drawing the two sides of the table together into a closed and compact state. This process is assisted by compression springs within the support which are biased toward the table being in a folded position. When the table is later opened, the lower member retracts back to a position substantially within the upper member. Given the urging by the compression springs for the two members to separate, a latching mechanism is provided to secure the lower member to the upper member at a position whereby the table is prevented from leaving its unfolded state.

On many folding tables, however, the latching mechanism on the center leg support is triggered only when the table is fully unfolded and only when the lower member has been compressed into the upper member an exact and specific distance. This poses a number of problems in the operation of such tables over time.

One such problem is that a rise or bump in the floor beneath the center leg support so that it is elevated in comparison to the surface beneath the outer leg supports may make it difficult to completely unfold the table so as to activate the lock or latch present on the center support. Even if the user is successful in forcefully triggering the lock, the effort required can cause stress and oftentimes damage to the support structure itself as well as to any cap or other covering placed over the base of the support. In addition, given the unevenness found on most floors, repeated use of the table on such a surface will leave numerous holes or indentations where contact is made between the center leg support and the various elevated regions. These problems will continue unless a way is found by the user to either make an adjustment in the manner in which the support is held in place by the latching mechanism or identify those areas on a given floor over which the table should not be erected.

Another shortcoming is the inability of the latching mechanism on most folding tables to adjust to the strength of the person unfolding the table. Many custodians in schools and churches prefer that such tables lock "light". This means that he or she is not required to exert the additional force needed to further compress the lower member into the upper member before the latching mechanism finally latches. "Latching light" would also reduce the level of force needed to later unlatch the latching mechanism.

Other than either removing the latching mechanism and reinstalling it at a different location altogether on the center leg support or else grinding down the point of contact between the latch and its catch in order to make it easier to lock, there is little that can be done to make adjustments in the operation of the latching mechanism on many institutional folding tables so as to meet the needs of its particular user. Moreover, even these solutions have limited value since unfolding the table at a different spot in the school or church might require yet another readjustment.

This invention addresses these problems and shortcomings, however, in a simple and inexpensive manner.

OBJECTS OF THE INVENTION

It is a primary object of this invention to provide an improved latching mechanism adapted for use on an institutional folding table overcoming some of the problems and shortcomings of the prior art, including those mentioned above.

Another object of this invention is to provide a novel latching mechanism that is easily adjustable and yet highly reliable in operation.

Another object of this invention is to provide a latching mechanism that can be adjusted so that it latches the center leg support in varying positions and without requiring the table to be fully unfolded.

Another object of this invention is to provide an exceptional latching mechanism that allows the user to adjust the force needed to latch the central leg support in position when opening the table as well as to unlatch the mechanism when returning the table to a folded position.

Another object of this invention is to provide a latching mechanism for use on an institutional folding table that allows adjustments in the mechanism to be made by the user at the time and place of use rather than requiring service personnel for such adjustments.

Another object of the invention is to provide an improved latching mechanism that is adjustable and yet simple to manufacture, relatively inexpensive to install and maintain, and easy to operate.

Another object of this invention is to provide a novel latching mechanism that allows the user to adjust the force needed to latch the outer leg supports together when folding the table closed as well as to unlatch the mechanism when returning the table to an open or unfolded position.

SUMMARY OF THE INVENTION

This invention is an improvement to an institutional folding table of the type having a pair of table top sections hinged together so that the table can be folded and unfolded and having first and second leg support members. The improvement comprises a latching mechanism having a first latching member slidably mounted onto the first leg support member and a second latching member mounted onto the second leg support member. Each latching member is in registry with the other. The slidable attachment of the first latching member allows it the freedom to be extended and retracted within limits along the first leg support member so as to achieve many different positions where the second latching member engages it so that the mechanism latches.

In one preferred embodiment of this invention, the first leg support member and the second leg support member are the upper leg member and lower leg member respectively of a center leg support on an institutional folding table. The lower leg member is slidably mounted with respect to an upper leg member in such a manner that the second latching member is only able to engage the first latching member when the table is in a substantially unfolded position. One highly preferred form of this embodiment is where the first latching member is a latch and the second latching member is a catch. In this configuration, the latch is preferably mounted to a collar that is slidably attached to the upper leg member. Also mounted to the collar is a latch-bracket. An adjustment-bracket is mounted onto the upper leg member which is connected to the latch-bracket by an adjustment mechanism.

In an alternative preferred form of this embodiment, the adjustment mechanism rotatably connects the adjustment-bracket to the latch-bracket so that the latch is free to be infinitely extended and retracted between limits. One common and preferred embodiment of such an adjustment mechanism is where the mechanism is comprised of a bolt having a distal end that is threaded for a certain length and a compression spring. In this embodiment of the invention, the limits of extension and retraction for the latch are substantially established by the length of the bolt that is threaded.

Another highly preferred form of the embodiment where the first leg support member and the second leg support member are the upper leg member and lower leg member respectively of a center leg support has the first latching member is a catch and the second latching member is a latch. In this configuration, an adjustment-bracket is preferably mounted onto the upper leg member. The catch is mounted to a catch-bracket that is slidably attached to the upper leg member. An adjustment mechanism then connects the adjustment-bracket to the catch-bracket. Most preferred is where the adjustment mechanism rotatably connects the adjustment-bracket to the catch-bracket so that the catch is then free to infinitely extend and retract between limits. One highly preferred embodiment of this form for the adjustment mechanism is where the mechanism is comprised of a bolt having a distal end that is threaded for a certain length and a compression spring. With this embodiment of the invention, the limits of extension and retraction for the catch are set by the length of the bolt that is threaded.

In a certain preferred embodiment of this invention, the institutional folding table has a pair of outer leg supports where the first leg support member is one of the outer leg supports and the second leg support member is the other. In this embodiment, the second latching member engages the first latching member when the table is in a substantially folded position. In one preferred form of this embodiment, the first latching member is a latch and the second latching member is a catch. It is highly appreciated in this form that the latch be mounted onto a collar that is slidably attached to the first outer leg support, a latch-bracket also be mounted onto the collar, an adjustment-bracket be mounted to the first outer leg support, and an adjustment mechanism connect the adjustment-bracket to the latch-bracket.

In another aspect of this invention, it constitutes an improvement in an institutional folding table of the type having a pair of top sections hinged to one another for movement of the table between folded and unfolded positions, a center leg support having a first center-leg member slidably disposed with respect to a second center-leg member, and a latching mechanism to secure the first center-leg member to the second center-leg member when the table is in a substantially unfolded position, wherein the latching mechanism is adjustable. In one highly preferred embodiment, the latching mechanism is comprised of a latch mounted to a collar slidably attached to the first center-leg member, a latch-bracket also mounted to the collar, an adjustment-bracket mounted to the first center-leg member, an adjustment mechanism connecting the adjustment-bracket to the latch-bracket, and a catch mounted to the second center-leg member in registry with the latch. This configuration allows the latch to be extended and retracted along the first center-leg member within limits so that there are a multiplicity of positions where the catch can engage the latch.

A most preferred embodiment finds the latching comprised of an adjustment-bracket mounted to the first center-leg member, a catch-bracket slidably attached to the first center-leg member, a catch mounted to the catch bracket, an adjustment mechanism connecting the adjustment-bracket to the catch-bracket, and a latch mounted to the second center-leg member in registry with the catch. In this configuration, the catch can be extended and retracted along the first center-leg member between certain limits so as to allow it to achieve many different positions where it can be engaged by the latch.

DETAILED DESCRIPTION OF PREFERRED EMBODIMENTS

The drawings illustrate a latching mechanism 10 in accordance with this invention. One preferred embodiment is particularly shown in FIG. 1.

Figure 1:
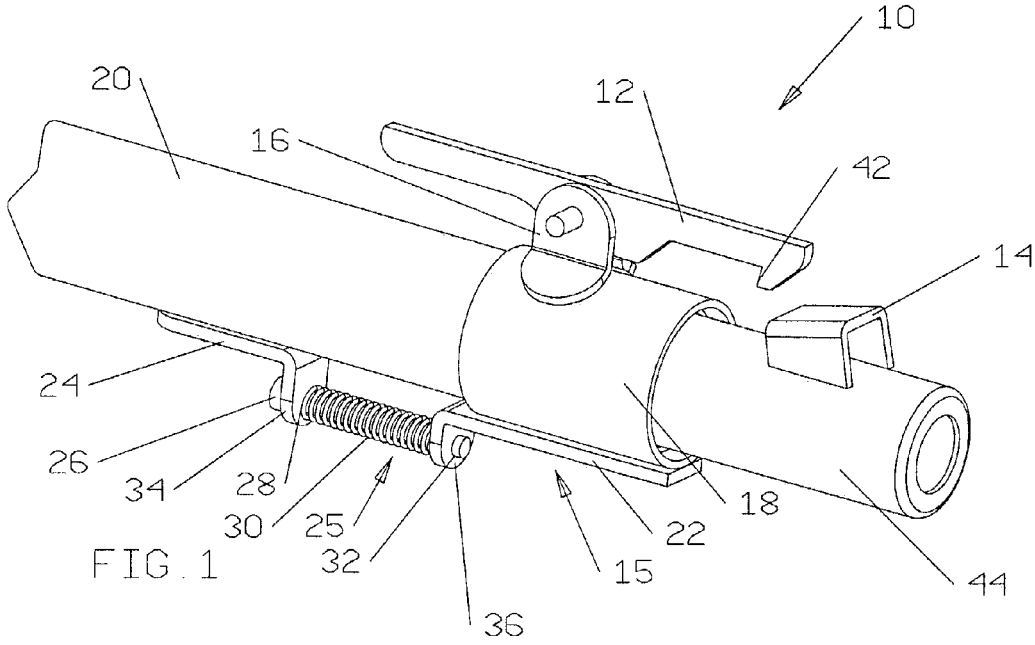
FIG. 1 is a perspective view of a preferred latching mechanism in accordance with this invention having an adjustable latch.
Figure 3:
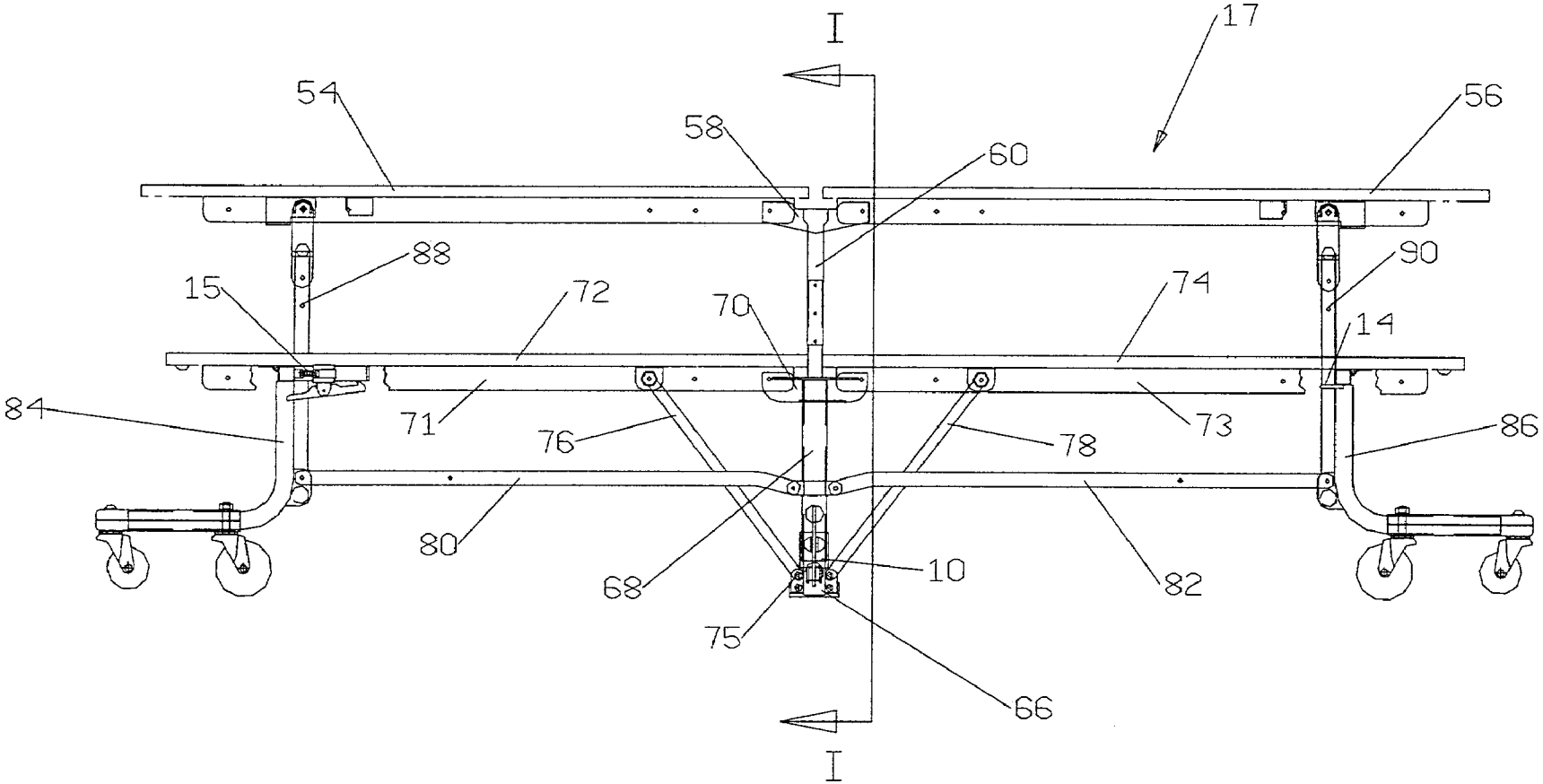
FIG. 3 is a front view of an institutional folding table in an unfolded configuration with the latching mechanism on the center leg support engaged and with a partial cut-out of the first and second apron sections.

Referring to FIGS. 1 and 3, latching mechanism 10 includes a latch 12 and a catch 14. Latch 12 is pivotally attached to a latch-support 16 so as to allow either end of latch 12 to swing upward or downward with respect to latch-support 16. Latch 12 is provided with a beak portion 42 on the end facing catch 14. A torsion spring (not shown) is attached between latch 12 and latch-support 16 so as to bias beak portion 42 in a downward direction.

Latch 12 and latch-support 16 are part of an adjustable latch assembly 15 attached to a first leg support member 20 on an institutional folding table 17. Latch-support 16 is rigidly secured to a collar 18 that freely circumscribes first leg support member 20. A latch-bracket 22 is rigidly attached to collar 18 at a location apart from latch-support 16 and in an orientation whereby the length of latch-bracket 22 runs in a direction parallel with the length of latch 12. An adjustment-bracket 24 is firmly secured to first leg support member 20 in registry with latch-bracket 22. Adjustment-bracket 24 is mechanically connected to latch-bracket 22 by an adjustment mechanism 25. Preferably, adjustment mechanism 25 comprises a bolt 26 and an adjustment spring 30. Bolt 26 passes first through a first bracket-aperture 28, followed by adjustment spring 30, and then a second bracket-aperture 32.

As shown in FIG. 1, first bracket-aperture 28 is located on a first tab 34 that is integral with adjustment-bracket 24 at the end closest to latch 12. First tab 34 extends outward from first leg support member 20. First bracket-aperture 28 is non-threaded but sized to receive bolt 26.

Second bracket-aperture 32 is located on a second tab 36 that is integral with latch-bracket 22 at the end facing adjustment-bracket 24. Second tab 36 extends outward from first leg support member 20 so that second bracket-aperture 32 is in registry with first bracket-aperture 28. Second bracket-aperture 32 is threaded and sized to receive bolt 26.

Turning or rotating bolt 26 so as to thread it through second bracket-aperture 32 in one direction or the other results in a sliding movement of collar 18 (and thereby latch 12) along first leg support member 20. The range of movement in latch-bracket 22 will substantially correspond to the length of the portion of bolt 26 that is threaded and to the degree to which adjustment spring 30 can be compressed.

Adjustment spring 30 serves to restrain bolt 26 from freely sliding through first bracket-aperture 28 while, at the same time, allowing bolt 26 to turn freely. Alternative forms of adjusting mechanism 25 include substituting a nut for adjustment spring 30 wherein the nut is threaded up to the side of first bracket-aperture 28 opposite from the head of bolt 26. A cotter pin or roll pin can also be inserted through the shaft of bolt 26 at a point adjacent to first bracket-aperture 28 on the side facing latch 12 so as to also restrain lateral movement of bolt 26 through that aperture. Additional mechanisms will be apparent to those skilled in the art.

As shown in FIG. 1, catch 14 is rigidly attached to a second leg support member 44 in registry with latch 12. Preferably, catch 14 is an angle catch as seen in FIG. 1 or a rod catch as seen in FIG. 5A. Catch 14, like latch 12, can, however, have different configurations in accordance with this invention. It will be apparent to those skilled in the art that latch 12 will have in any configuration a structure that permits it to engage catch 14. Likewise, a skilled artisan will recognize that catch 14 will have in each configuration a structure that permits it to be engaged by latch 12.

In many embodiments of this invention, as illustrated in FIG. 1, second leg support member 44 is telescopically disposed within first leg support member 20. In most of these embodiments, a compression spring (not shown) is mounted within first leg support member 20 so as to bias second leg support member 44 in a direction outward from first leg support member 20.

In operation, beak portion 42 of latch 12 engages or hooks catch 14 on the side opposite to latch 12 to fasten first leg support member 20 to second leg support member 44. The bias between leg support members 20 and 44 to move away from each other keeps latch 12 engaged with catch 14. By pivoting beak portion 42 upward, latch 12 can be released from catch 14.

It can be seen that the present invention results in achieving a multiplicity of positions for latch 12 along first leg support member 20. In certain applications, each position determines the extent to which second leg support member 44 needs to be compressed within first leg support member 20 before latch 12 engages catch 14 to fasten both members together.

Figure 2:
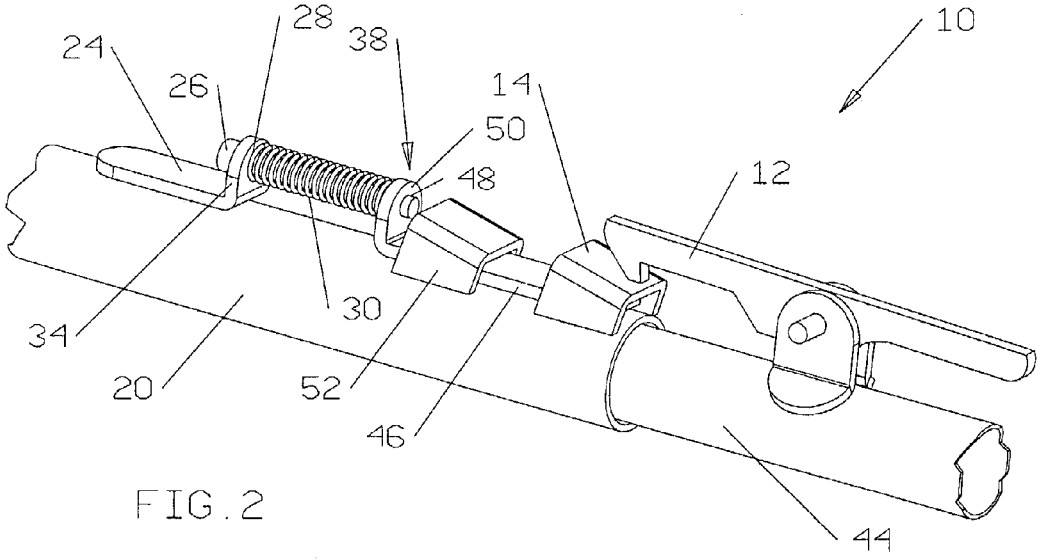
FIG. 2 is a perspective view of another preferred latching mechanism in accordance with this invention having an adjustable catch.

Another preferred embodiment in accordance with this invention is shown in FIG. 2. In this embodiment, catch 14 is adjustable and mounted with respect to first leg support member 20 while latch 12 is pivotally attached to a latch-support 16 that is rigidly secured to second leg support member 44.

Catch 14 is part of an adjustable catch assembly 38 attached to first leg support member 20. Catch 14 is firmly attached to a catch-bracket 46. Catch-bracket 46 is positioned on first leg support member 20 so as to be in registry with latch 12 and an adjustment-bracket 24. Adjustment-bracket 24 is rigidly attached to first leg support member 20. Adjustment-bracket 24 is mechanically linked to catch-bracket 46 by a bolt 26 in the manner described below.

As illustrated in FIG. 2, bolt 26 passes through a first bracket-aperture 28, an adjustment spring 30, and a third bracket-aperture 48. First bracket-aperture 28 is located on first tab 34 of adjustment-bracket 24. Third bracket-aperture 48 is formed on a third tab 50 that is integral with catch-bracket 46 at the end facing adjustment-bracket 24. Third tab 50 extends outward from first leg support member 20 so that third bracket-aperture 48 is in registry with first bracket-aperture 28. While both apertures 28 and 48 are sized to receive bolt 26, first bracket-aperture 28 is non-threaded while third bracket-aperture 48 is threaded.

In operation, the act of turning bolt 26 (with a driver chosen on the basis of the type of bolt selected) results in a sliding extension or retraction of catch-bracket 46 along first leg support member 20. Since the only attachment of catch-bracket 46 to first leg support member 20 is by means of bolt 26, a guide 52 is provided to keep catch-bracket 46 (and thereby catch 14) in registry with latch 12. Guide 52 is rigidly mounted onto first leg support member 20 and straddles catch-bracket 46 so that catch-bracket 46 is only free to move in a direction aligned with latch 12.

As with certain applications of this invention where the position of latch 12 is adjustable, the adjustability in the position of catch 14 allows variability as to the extent to which second leg support member 44 needs to be compressed within first leg support member 20 before latching mechanism 10 is engaged. This adjustability can further be achieved with embodiments where adjustable latch assembly 15 described earlier is mounted on second leg support member 44 while catch 14 is stationary and fixed to first leg support member 20. Likewise embodiments consistent with this invention include ones where adjustable catch assembly 38 described above is attached to second leg support member 44 and latch 12 is rigidly mounted on first leg support member 20 instead.

Figure 4:
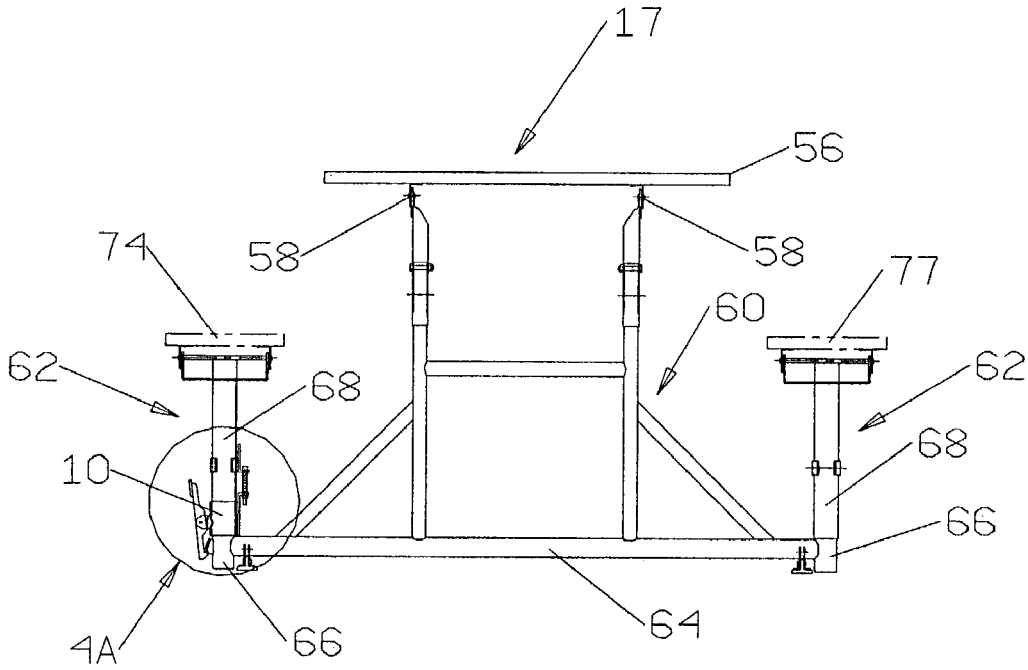
FIG. 4 is a cross-sectional view taken substantially on the line I—I of FIG. 3.
Figure 4A:
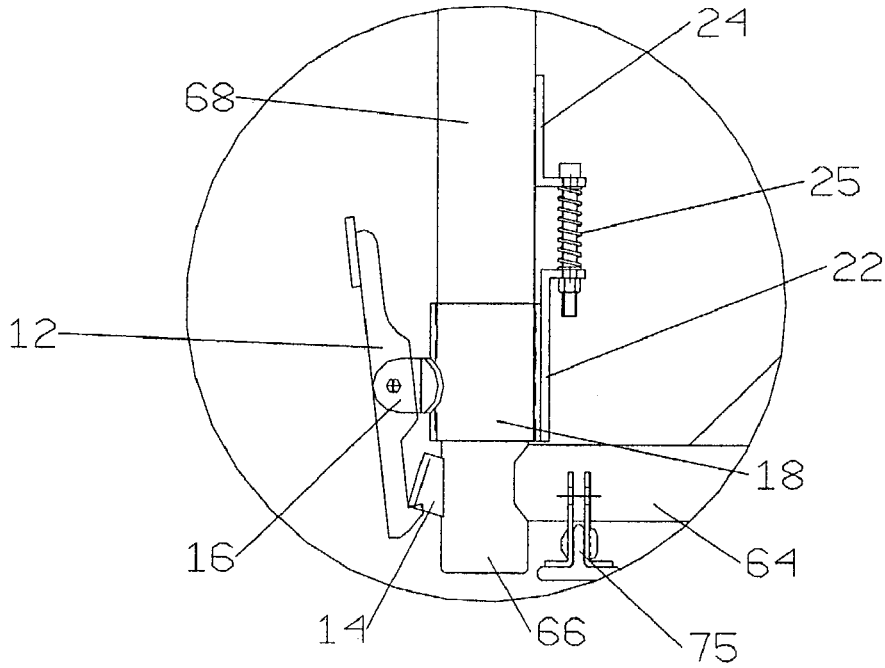
FIG. 4A is a detailed view of area 4A in FIG. 4.

FIGS. 3, 4 and 4A illustrate an institutional folding table 17 having a latching mechanism 10 in accordance with this invention. Table 17 has a pair of table-top sections 54 and 56 in substantially end-to-end relationship that are pivotally secured together at their abutting end portions by a pair of top hinges 58. In a manner known to those skilled in the art, top hinges 58 are attached to a center support assembly 60 that is structurally connected to a pair of center leg supports 62. In particular, a horizontal cross bar 64 is rigidly joined at both ends to a lower leg member 66 on each center leg support 62.

Lower leg member 66 is telescopically disposed within an upper leg member 68 on each center leg support 62. As shown in FIG. 3, upper leg member 68 is attached at its upper end to bench hinges 70 that pivotally join together a pair of bench sections 72 and 74. Diagonal stretcher bars 76 and 78 are pivotally attached at their upper ends to bench sections 72 and 74 at first apron section 71 and second apron section 73 respectively. Diagonal stretcher bars 76 and 78 are attached at their lower ends to pivots 75 on horizontal cross bar 64, whereby bench sections 72 and 74 are then mechanically connected to lower leg member 66.

Latch 12 is shown in FIG. 4A slidably attached to upper leg member 68 in the manner in accordance with this invention. Catch 14 is likewise shown rigidly mounted on lower leg member 66.

A compression spring (not shown) is mounted within each upper leg member 68 so as to bias lower leg member 66 in an outward direction. More specifically, the action of the compression spring is to aid in the folding of table 17 by forcing upper leg member 68 upward and away from lower leg member 66.

As will be readily recognized by those skilled in the art, the upward motion of upper leg members 68 draws together not only all bench sections (only bench sections 72, 74, 77 are shown) but also table top sections 54 and 56 in a closed and folded configuration through linkage between upper leg member 68 and table top sections 54 and 56. With respect to the upper leg member 68 shown in FIG. 3, such linkage consists of horizontal stretcher bars 80 and 82 that are pivotally connected to upper leg member 68 at their inner ends and pivotally connected to a first outer leg support 84 and a second outer leg support 86 at their outer ends respectively. Outer leg supports 84 and 86 are rigidly mounted to a first outer support assembly 88 and a second outer support assembly 90 respectively. In turn, the upper ends of outer support assemblies 88 and 90 are pivotally attached to table top sections 54 and 56 respectively. Table top sections 54 and 56 are thereby drawn together as outer leg supports 84 and 86 are drawn towards center leg support 62 when upper leg member 68 moves upward.

Latching mechanism 10 is utilized to maintain table 17 in an open and unfolded position. Given the bias toward the closed and folded position, unfolding of table 17 requires compression of the spring within each upper leg member 68 followed by the fastening of at least one upper leg member 68 to the corresponding lower leg member 66. Compression of the spring is typically accomplished by some individual who, in unfolding table 17, physically pushes the inner ends of table top sections 54 and 56 together. Adjustment of latching mechanism 10 in the manner described above will determine the extent to which top sections 54 and 56 must be forced together before latch 12 engages catch 14. Adjusting of latching mechanism 10 so as to bring latch 12 in closer proximity to catch 14 will mean less compression of lower leg member 66 within upper leg member 68 is required before latching mechanism 10 is fastened when latch 12 engages catch 14.

Figure 5:
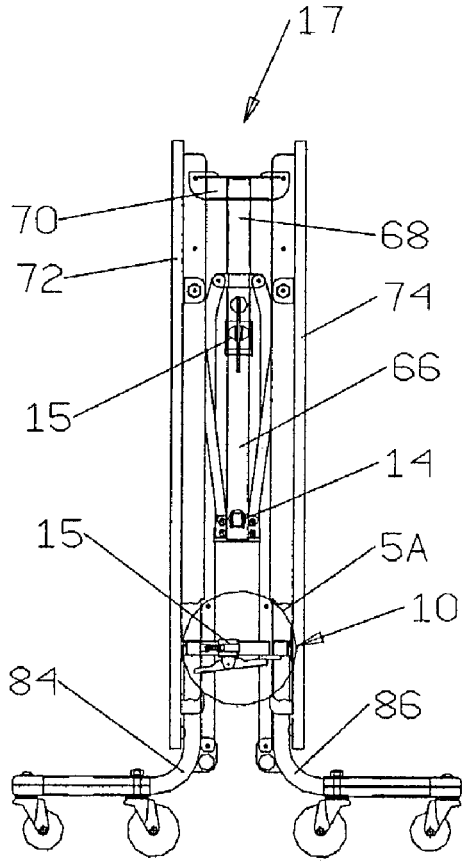
FIG. 5 is a side view of the institutional folding table of FIG. 3 in a folded configuration with the latching mechanism on the outer leg supports engaged and with a partial cut-out of the first and second apron sections.
Figure 5A:
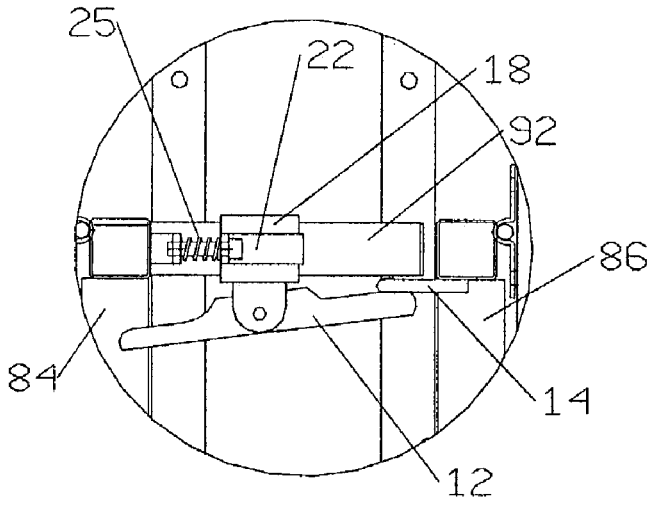
FIG. 5A is a detailed view of area 5A in FIG. 5 with first and second apron sections cut-out.

As shown in FIGS. 5 and 5A, latching mechanism 10 of this invention can be used to fasten together the two halves of an institutional folding table 17 in its closed or folded configuration as well. Latch 12 is slidably mounted in the manner described above to a horizontal member 92 attached to first outer leg support 84. Catch 14 is firmly secured to second outer leg support 86. Adjustment of the latch assembly 15 to move latch 12 in the direction of catch 14 will then permit table 17 to be secured in a closed position with less force than before the adjustment.

Thus, it should be apparent that there has been provided, in accordance with the present invention, a novel device for efficiently and effectively latching leg support members on an institutional folding table that fully satisfies the objectives and advantages set forth above.

The various parts shown in the drawings and described above may be fabricated using a variety of materials and a variety of assembly procedures known to those skilled in the art. Moreover, it will be apparent to one skilled in the art that a latching mechanism in accordance with this invention will preferably be made from materials selected to be sufficient to withstand the forces anticipated to be applied to it. The choice of material will therefore depend on the particular application being made of the latching mechanism.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The invention claimed is:

1. In an institutional folding table of the type having a pair of table top sections hinged to one another for movement of the table between folded and unfolded positions and first and second leg support members, the improvement comprising a latching mechanism wherein:

a first latching member slidably mounted with respect to the first leg support member; and a second latching member mounted with respect to the second leg support member in registry with the first latching member, whereby the first latching member can be extended and retracted along the first leg support member between limits so as to permit a multiplicity of positions where the second latching member can engage the first latching member.

2. The table of claim 1 wherein the table has a center leg support, the center leg support having a lower leg member slidably mounted with respect to an upper leg member, and wherein the first leg support member is the upper leg member and the second leg support member is the lower leg member, whereby the second latching member engages the first latching member when the table is in a substantially unfolded position.

3. The table of claim 2 wherein the first latching member is a latch and the second latching member is a catch.

4. The table of claim 3 wherein:

the latch is mounted with respect to a collar slidably attached with respect to the upper leg member;

a latch-bracket is mounted with respect to the collar;

an adjustment-bracket is mounted with respect to the upper leg member; and an adjustment mechanism connects the adjustment-bracket to the latch-bracket.

5. The table of claim 4 wherein the adjustment mechanism is rotatably connecting the adjustment-bracket to the latch-bracket, whereby the latch is free to infinitely extend and retract between limits.

6. The table of claim 5 wherein the adjustment mechanism comprises:

a bolt having a distal end that is threaded for a length; and a compression spring, whereby the limits of extension and retraction for the latch is substantially the length of bolt that is threaded.

7. The table of claim 6 wherein a first tab extends outward from the adjustment-bracket, the first tab defining a first aperture sized to receive the bolt, and a second tab extends outward from the latch-bracket, the second tab defining a second aperture sized to threadably receive the distal end of the bolt, the apertures being in registry such that rotation of the bolt slidably moves the collar along the upper leg member.

8. The table of claim 2 wherein the first latching member is a catch and the second latching member is a latch.

9. The table of claim 8 wherein:

an adjustment-bracket is mounted with respect to the upper leg member;

a catch-bracket is slidably attached with respect to the upper leg member;

the catch is mounted with respect to the catch bracket; and an adjustment mechanism connects the adjustment-bracket to the catch-bracket.

10. The table of claim 9 wherein the adjustment mechanism is rotatably connecting the adjustment-bracket to the catch-bracket, whereby the catch is free to infinitely extend and retract between limits.

11. The table of claim 10 wherein the adjustment mechanism comprises:

a bolt having a distal end that is threaded for a length; and a compression spring, whereby the limits of extension and retraction for the catch is substantially the length of bolt that is threaded.

12. The table of claim 1 wherein the table has a first outer leg support and a second outer leg support and wherein the first leg support member is the first outer leg support and the second leg support member is the second outer leg support, whereby the second latching member engages the first latching member when the table is in a substantially folded position.

13. The table of claim 12 wherein the first latching member is a latch and the second latching member is a catch.

14. The table of claim 13 wherein:

the latch is mounted with respect to a collar slidably attached with respect to the first outer leg support;

a latch-bracket mounted with respect to the collar;

an adjustment-bracelet mounted with respect to the first outer leg support; and an adjustment mechanism connecting the adjustment-bracket to the latch-bracket.

15. The table of claim 1 wherein the table has a center leg support, the center leg support having a lower leg member slidably mounted with respect to an upper leg member, and wherein the first leg support member is the lower leg member and the second leg support member is the upper leg member, whereby the second latching member engages the first latching member when the table is in a substantially unfolded position.

16. In an institutional folding table of the type having a pair of top sections hinged to one another for movement of the table between folded and unfolded positions, a center leg support having a first center-leg member slidably disposed with respect to a second center-leg member, and a latching mechanism to releasably secure the first center-leg member to the second center-leg member when the table is in a substantially unfolded position, the improvement wherein the latching mechanism has at least one adjustable latching member mounted with respect to a member rigidly attached to one of the center-leg members.

17. In an institutional folding table of the type having a pair of top sections hinged to one another for movement of the table between folded and unfolded positions, a center leg support having a first center-leg member slidably disposed with respect to a second center-leg member, and a latching mechanism to releasably secure the first center-leg member to the second center-leg member when the table is in a substantially unfolded position, the improvement wherein the latching mechanism includes a latch and wherein:

the latch is mounted with respect to a collar slidably attached with respect to the first center-leg member;

a latch-bracket is mounted with respect to the collar;

an adjustment-bracket is mounted with respect to the first center-leg member;

an adjustment mechanism connects the adjustment-bracket to the latch-bracket; and a catch is mounted with respect to the second center-leg member in registry with the latch, whereby the latch can be extended and retracted along the first center-leg member between limits so as to permit a multiplicity of positions where the catch can engage the latch.

18. The table of claim 17 wherein the collar circumscribes the first center-leg member.

19. In an institutional folding table of the type having a pair of top sections hinged to one another for movement of the table between folded and unfolded positions, a center leg support having a first center-leg member slidably disposed with respect to a second center-leg member, and a latching mechanism to releasably secure the first center-leg member to the second center-leg member when the table is in a substantially unfolded position, the improvement wherein the latching mechanism includes a catch and wherein:

an adjustment-bracket is mounted with respect to the first center-leg member;

a catch-bracket is slidably attached with respect to the first center-leg member;

the catch is mounted with respect to the catch bracket;

an adjustment mechanism connects the adjustment-bracket to the catch-bracket; and a latch is mounted with respect to the second center-leg member in registry with the catch, whereby the catch can be extended and retracted along the first center-leg member between limits so as to permit a multiplicity of positions where the latch can engage the catch.

20. The table of claim 19 further comprising a guide rigidly mounted to the first center-leg member, the guide being positioned to straddle the catch-bracket such that the catch-bracket is only free to move along the first center-leg member in a direction aligned with the latch.

* * * * *

UNITED STATES PATENT AND TRADEMARK OFFICE

CERTIFICATE OF CORRECTION

PATENT NO. : 7,032,524 B1
APPLICATION NO. : 10/365213
DATED : April 25, 2006
INVENTOR(S) : Francis L. Pajerski It is certified that error appears in the above-identified patent and that said Letters Patent is hereby corrected as shown below:

On The Title Page, Item (73)
(73) Assignee: delete words "Palmer Snyder Furniture Co." and replace it with the words --Palmer Hamilton, LLC--.

In the Claims:

In Column 9, line 32, delete the word "bracelet" after "adjustment-" and add the word --bracket--.

Signed and Sealed this

Eighteenth Day of September, 2007

JON W. DUDAS
*Director of the United States Patent and Trademark Office*